United States Patent [19]

Meyers

[11] 4,256,923

[45] Mar. 17, 1981

[54] SOUND REPRODUCING SYSTEM UTILIZING MOTIONAL FEEDBACK AND INTEGRATED MAGNETIC STRUCTURE

[76] Inventor: Stanley T. Meyers, 122 N. Riverside Ave., Red Bank, N.J. 07701

[21] Appl. No.: 67,516

[22] Filed: Aug. 17, 1979

[51] Int. Cl.[3] ..... H04R 3/00

[52] U.S. Cl. ..... 179/1 F

[58] Field of Search ..... 179/1 D, 1 F, 1 P, 1 A, 179/1 FS, 115.5 R, 115.5 DV, 115.5 VC; 330/109, 110; 333/28 T; 181/31B

[56] References Cited

U.S. PATENT DOCUMENTS

| | | | |
|---|---|---|---|
| 3,798,374 | 3/1974 | Meyers | 179/1 F |
| 3,821,473 | 6/1974 | Mullins | 179/1 F |
| 3,878,748 | 4/1975 | Spence | 179/1 F |
| 4,025,722 | 5/1977 | Karron | 179/1 F |

OTHER PUBLICATIONS

"The Philips Motional Feedback System", undated Trade Circular distributed by North American Philips Corp.

*Primary Examiner*—Thomas A. Robinson

*Attorney, Agent, or Firm*—R. Martin Oliveras

[57] ABSTRACT

A sound reproducing system utilizes motional feedback and an integrated magnetic structure to reduce loud speaker distortion. The loud speaker structure of such system comprises a main electromagnetic structure and a cone motion sensing structure. The main electromagnetic structure includes a cup-shaped cylindrical iron outer pole piece, a solid cylindrical permanent magnet, a solid cylindrical iron inner pole piece, a main voice coil, a thin cylindrical bobbin, a cone, a speaker frame, and flexible webs. The cone motion sensing structure includes a hollow cylindrical iron outer sleeve, a hollow cylindrical copper outer sleeve, a disc-shaped non-magnetic support, a hollow cylindrical copper inner sleeve, a solid cylindrical iron rod, a feedback coil, a thin feedback bobbin, and a conical member connecting the feedback bobbin to the voice coil bobbin. A stability control network is connected to the feedback coil for suppressing any supersonic transmission peaks appearing in the motional feedback signal. A feature of the present invention is that: the cone motion sensing structure utilizes the stray magnetic field of the main electromagnetic structure to provide the motional feedback signal which is functionally related to axial cone velocity, which motional feedback signal is fed directly to the stability control network as aforementioned. An advantage of the present invention is that it allows use of smaller loud speakers and loud speaker enclosures.

27 Claims, 3 Drawing Figures

SOUND REPRODUCING SYSTEM UTILIZING MOTIONAL FEEDBACK AND INTEGRATED MAGNETIC STRUCTURE

CROSS REFERENCE TO RELATED APPLICATIONS

This application is related to copending application Ser. No. 067,515, entitled "Sound Reproducing System Utilizing Motional Feedback And Velocity-Frequency Equalization", filed simultaneously herewith.

FIELD OF THE INVENTION

This invention relates to sound reproducing systems and, in particular, to such systems which include the loud speaker in a feedback path.

BACKGROUND OF THE INVENTION

Several prior art sound reproducing systems have included the loud speaker in a feedback path for reducing loud speaker distortion, and for allowing the use of smaller loud speakers and loud speaker enclosures. Such prior art systems, especially those which include means for magnetically sensing the axial motion of the associated loud speaker cone, have considered neither the detrimental effects due to electrical interference from the main electromagnetic loud speaker structure, nor the proper frequency shaping of the motional feedback signal to cause the loud speaker to respond linearly to the input source signal. Such prior art sound reproducing systems are cited in U.S. Pat. No. 3,798,374 entitled, "Sound Reproducing System Utilizing Motional Feedback", issued on Mar. 19, 1974 to Stanley Thayer Meyers, Applicant herein.

Further, U.S. Pat. No. 3,821,473 entitled, "Sound Reproduction With Driven And Undriven Speakers And Motional Feedback", issued on June 28, 1974 to Mullins discloses amplifier 4, device 12, and speakers 14 and 16. In such system, there is included an undriven speaker and each of the speakers mounted in the enclosure have different resonant frequencies and motional feedback devices attached thereto. The outputs of the motional feedback devices are combined to provide a negative feedback signal to the amplifier. The system also includes motional sensor 18. Such sound reproduction system relates to combined motional feedback control of driving and driven speakers in a single enclosure. There does not appear to be a description of any particular type of motional feedback sensing means, although acceleration sensing is mentioned.

U.S. Pat. No. 3,878,748 entitled, "Oral Cavity Controlled Electronic Musical Instrument", issued on Apr. 22, 1975 to Spence discloses sensor coil 58. FIG. 9 of such patent refers to a method of divesting a separate sensing coil of interference from the voice coil. Such arrangement appears to be a ramification of bridge type feedback control.

U.S. Pat. No. 4,025,722 entitled, "Method And Apparatus For Recording", issued on May 24, 1977 to Karron discloses speaker 20 including voice coil 18 and auxiliary winding 30. The output of auxiliary winding 30 is coupled to primary winding 32 of transformer 34, but does not appear to be fed back to amplifiers 16 thereof.

The North American Philips Corporation distributes a sound reproducing system including a signal source, an electronic crossover, a comparator, a low frequency amplifier, a woofer, a piezoelectric sensor, a high frequency amplifier, a second crossover, a mid-range speaker, and a tweeter speaker. In such sound reproducing system, acceleration feedback is utilized but only in the so-called woofer speaker.

However, none of the aforementioned prior art sound reproducing systems includes the particular cone motion sensing structure to produce a motional feedback signal according to the present invention.

Objects of the present invention are therefore to:

Utilize motional feedback in a sound reproducing system for reducing loud speaker distortion, for providing a uniform sound energy output, and for effecting linear loud speaker response to the input source signal;

Utilize motional feedback in a sound reproducing system wherein relatively small loud speakers and loud speaker enclosures are required; and Utilize the stray magnetic field of the loud speaker main electromagnetic structure to provide a motional feedback signal readout of the loud speaker cone.

SUMMARY OF THE INVENTION

According to the present invention, a sound reproducing system utilizes motional feedback and an integrated magnetic structure to provide a substantially uniform sound energy output, to reduce loud speaker distortion, and for effecting linear loud speaker response to the input source signal. Such system includes a cone motion sensing structure which utilizes the stray magnetic field from the main loud speaker electromagnetic structure to provide the motional feedback signal. The overall loud speaker structure comprises a main electromagnetic structure and such cone motion sensing structure. The main electromagnetic structure includes a cup-shaped cylindrical iron outer pole piece, a solid cylindrical permanent magnet, a solid cylindrical iron inner pole piece, a main voice coil, a thin cylindrical bobbin, a cone, a speaker frame, and flexible webs. The cone motion sensing structure includes a hollow cylindrical iron outer sleeve, a hollow cylindrical copper outer sleeve, a disc-shaped non magnetic support, a hollow cylindrical copper inner sleeve, a solid cylindrical iron rod, a feedback coil, a thin feedback bobbin and a conical member connecting the feedback bobbin to the voice coil bobbin. A stability control network is connected to the feedback coil for suppressing any supersonic transmission peaks appearing in such motional feedback signal.

Features of the present invention are therefore that:

The motional feedback signal generated by the cone motion sensing structure is functionally related to axial cone velocity;

The cone motion sensing structure utilizes the stray magnetic field of the main electromagnetic loud speaker structure to provide such motional feedback signal;

The motional feedback signal from the cone motion sensing structure is substantially free from components due to current in the loud speaker voice coil whereby the motional feedback signal is a function of cone motion only.

Advantages of the present invention are therefore that:

Relatively small loud speakers and loud speaker enclosures can be utilized;

Loud speaker diaphragm performance is substantially independent of enclosure characteristics; and A separate electromagnetic structure is not required for the functioning of the cone motion sensing structure.

DESCRIPTION OF THE DRAWING

The above and other objects, features, and advantages of the present invention will be better appreciated by consideration of the following detailed description and the drawing in which.

DETAILED DESCRIPTION

Figure 1:
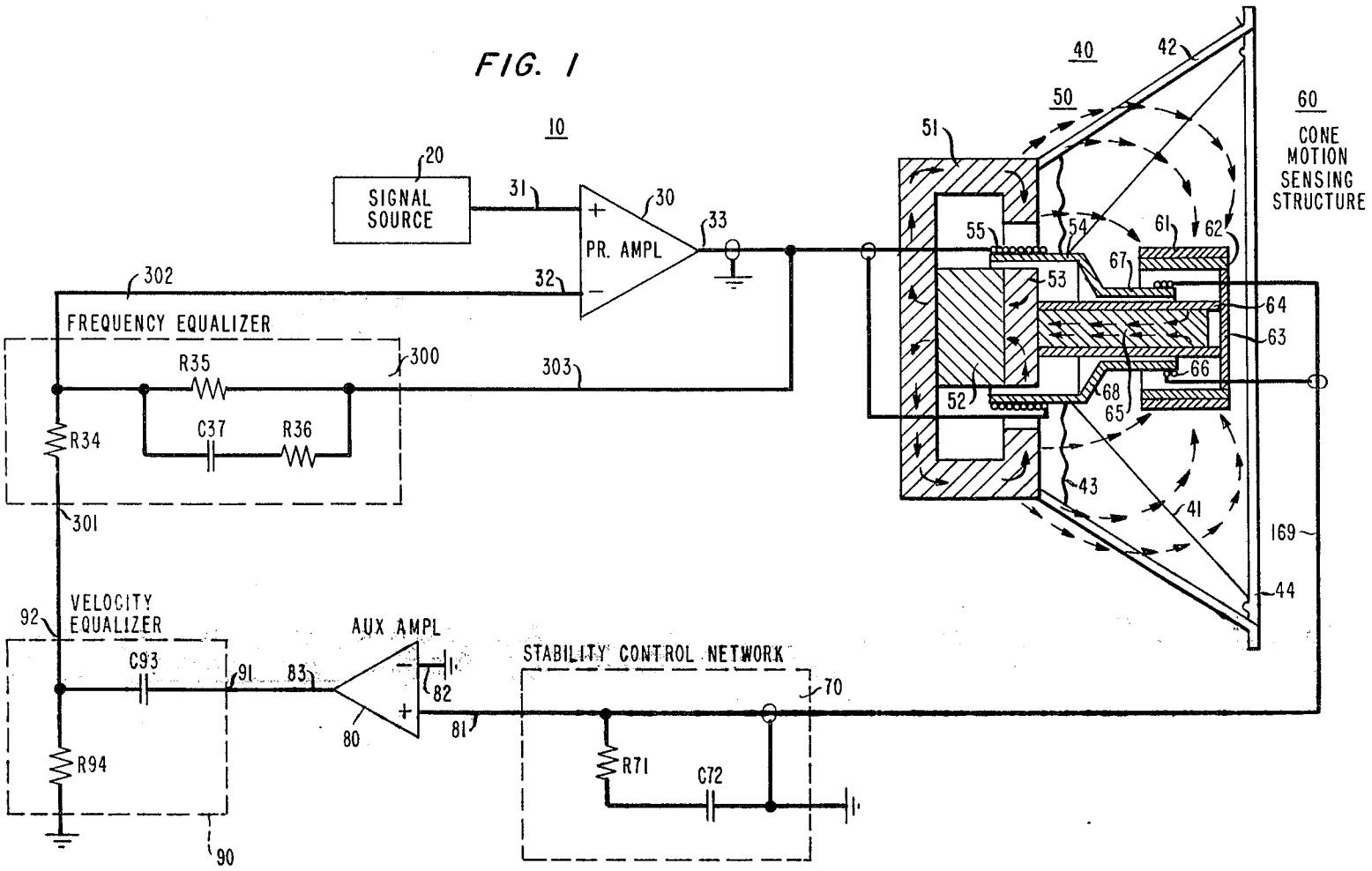
FIG. 1 illustrates a second reproducing system utilizing motional feedback and an integrated magnetic structure according to the present invention.

FIG. 1 illustrates sound reproducing system 10 utilizing motional feedback and an integrated magnetic structure generally comprising frequency equalized power amplifier 30 which is jointly responsive to signal source 20 and velocity feedback equalizer 90; moving-coil type loud speaker structure 40 which is responsive to power amplifier 30; stability control network 70 which is responsive to loud speaker structure 40; auxiliary amplifier 80 which is responsive to stability control network 70; and aforementioned feedback equalizer 90 which is responsive to auxiliary amplifier 80. Frequency equalized power amplifier 30 and velocity feedback equalizer 90 of system 10 are disclosed and claimed in said copending application, Ser. No. 067,515.

Loud speaker structure 40 further comprises main electromagnetic structure 50 and cone motion sensing structure 60. Main electromagnetic structure 50 includes cup-shaped cylindrical iron outer pole piece 51, solid cylindrical permanent magnet 52, solid cylindrical iron inner pole piece 53, main voice coil 55, thin cylindrical bobbin 54, cone 41, speaker frame 42, flexible web 43, and flexible web 44. Cone motion sensing structure 60 includes hollow cylindrical iron outer sleeve 61, hollow cylindrical copper outer sleeve 62, disc-shaped non magnetic support 63, hollow cylindrical copper inner sleeve 64, solid cylindrical iron rod 65, feedback coil 66, thin cylindrical feedback bobbin 67, and conical member 68 connecting feedback bobbin 67 to voice coil bobbin 54. The operation of main electromagnetic structure 50 and the dimensions, shapes, and configurations of its elements are well known in the art, and accordingly, shall not be described in detail herein.

Cone motion sensing structure 60 derives its own magnetic field from the stray magnetic field of main electromagnetic structure 50 to provide the motional feedback signal to stability control network 70 which is functionally related to the axial velocity of cone 41. The motion of cone 41 is derived mechanically by connecting the rearward end of feedback bobbin 67 to the forward end of voice coil bobbin 54 via conical support member 68. The inner diameter of iron outer sleeve 61 is greater than or equal to the outer diameter of copper outer sleeve 62 while the inner diameter of copper inner sleeve 64 is greater than or equal to the outer diameter of iron rod 65. A cylindrical axially directed annular gap is therefore formed and located in between the inner diameter of copper outer sleeve 62 and the outer diameter of copper inner sleeve 64. Feedback bobbin 67 including feedback coil 66 wound thereon is accordingly located in between copper outer sleeve 62 and copper inner sleeve 64 and moves axially within such cylindrical annular gap. The contour, shape, and dimensions of conical support member 68 are chosen so as to advantageously connect the axial frontal portion of voice coil bobbin 54 to the axial rearward portion of feedback bobbin 67. This connection should be as rigid as possible. The function of non-magnetic support 63 is to rigidly fix iron outer sleeve 61 and copper outer sleeve 62 with respect to main electromagnetic structure 50 via copper inner sleeve 64. Copper inner sleeve 64 and iron rod 65 may be attached to main pole piece 53 by way of adhesive or other suitable means. Copper inner sleeve 64 and iron rod 65 may also be attached to each other by way of adhesive or other suitable means. A similar explanation applies to: iron outer sleeve 61 and copper outer sleeve 62; and to non-magnetic sleeve support 63, iron outer sleeve 61, and/or copper outer sleeve 62. Feedback bobbin 67 can be fixedly attached to conical member 68 by way of adhesive or other suitable means. The same applies to voice coil bobbin 54 and conical member 68. Feedback bobbin 67 and conical member 68 can be made of materials and can be fixedly attached to each other utilizing methods known in the art. Feedback coil 66 can advantageously be wound axially along the outer diameter of feedback bobbin 67 utilizing methods also known in the prior art. It will be apparent to those skilled in the art that cone motion sensing structure 60 may be built integrally with main electromagnetic structure 50 of loud speaker 40 or may be built separately from main electromagnetic structure 50 and thereafter may be attached to main electromagnetic structure 50 utilizing methods known in the prior art. Outer sleeve 62 and inner sleeve 64 are advantageously made of a non-magnetic metal of good electrical conductivity, such as copper or aluminum, to minimize leakage interference.

The stray magnetic field emanating from main electromagnetic structure 50 is shown in FIG. 1 by way of dashed arrows emanating clockwise from the upper portion of main electromagnetic structure 50 and emanating counterclockwise from the lower portion of electromagnetic structure 50. Further, the magnetic field within main electromagnetic structure 50 follows the path comprising permanent magnet 52; the rearward portion of pole piece 51; the radially outward portion of pole piece 51; the forward portion of pole piece 51; the radially inward portion of the annular gap in between pole piece 51 and pole piece 53; main voice coil 55; the radially inward portion of the annular gap in between pole piece 51 and pole piece 53; pole piece 53; and permanent magnet 52 to complete the path. Further, the magnetic field associated with cone motion sensing structure 60 follows the path comprising: the radially outward and forward portions of pole piece 51; iron outer sleeve 61; copper outer sleeve 62; the radially outward portion of the annular gap in between copper outer sleeve 62 and copper inner sleeve 64; iron rod 65; pole piece 53; permanent magnet 52; the rearward portion of pole piece 51; and the radially outward and forward portions of pole piece 51 to complete the path.

Accordingly, axial motion of feedback bobbin 67 and feedback coil 66 along the cylindrical axially directed annular gap of cone motion sensing structure 60 causes a voltage to be induced in feedback coil 66 as feedback coil 66 cuts the flux lines of the magnetic field path formed in such gap as aforementioned. The voltage induced in feedback coil 66 is functionally related to the axial velocity of feedback coil 66, and thus is functionally related to the axial velocity of associated members including feedback bobbin 67, conical member 68, voice coil bobbin 54, and therefore cone 41.

In view of the above, iron outer sleeve 61 collects and concentrates the stray magnetic field in its vicinity and converts it to a uniform magnetic field in the annular gap located in between copper outer sleeve 62 and copper inner sleeve 64. The electrical conductivity of copper outer sleeve 62 and copper inner sleeve 64 causes the production of internal eddy currents which tend to counteract and substantially compensate for interfering electrical fields or variable magnetic fields produced by main electromagnetic structure 50. The outer diameter of copper inner sleeve 64 and the inner diameter of copper outer sleeve 62 are made as close as possible to each other in order to provide the smallest possible cylindrical annular gap between such sleeves without interfering with the motion of feedback bobbin 67 and feedback coil 66, and in order to produce the strongest and most uniform magnetic flux within such cylindrical annular gap.

Stability control network 70 suppresses any supersonic transmission peaks derived in the feedback coil signal. Such supersonic transmission peaks may result from mechanical resonance in the support mechanism of feedback coil 66. Such supersonic transmission peaks may be detrimental to feedback stability and may otherwise cause harmful circuit oscillation. Stability control network 70 comprises resistor R71 and capacitor C72 in series. The first terminal of resistor R71 is connected to conduction path 169, to wit, the common junction between feedback coil 66 and positive input terminal 81 of auxiliary amplifier 80. The second terminal of resistor R71 is connected to the first terminal of capacitor C72, and the second terminal of capacitor C72 is connected to ground. The effect of stability control network 70 is two fold: to provide a shunt path impedence for high frequency filtering and to provide a high frequency current path for generating an electrodynamic counterforce resistive to high frequency mechanical movement in feedback coil 66, thereby causing a reduction in the peak response due to mechanical resonance. Relative values of resistor R71 are 0 to about 10 ohms and of capacitor C72 are 0.5 to 1.5 microfarads. In other words, the preferred time constant R C is 0 to 1.5 microseconds.

As illustrated in FIG. 1, iron outer sleeve 61 is outermost and copper outer sleeve 62 is innermost. It has been determined that circuit performance is substantially unaffected when the positions of these two sleeves are interchanged such that iron outer sleeve 61 is innermost and copper outer sleeve 62 is outermost.

The length and diameter of the pole pieces of cone motion sensing structure 60 are dictated by a balancing of requirements. In general, though, the larger the diameter of such pole pieces, the greater the reduction in flux variations. However, the greater the diameter of such pole pieces, the more flux is deflected from the voice coil gap leading to a reduction in loud speaker efficiency. The longer one makes iron rod 65 and copper sleeve 64, the greater shall be the reduction in flux variations. However, the more one extends iron rod 65 outward, the longer cone motion sensing structure 60 becomes, with an attendent lowering of mechanical resonance and increased difficulty with stability control. In addition, were sensing structure 60 to extend beyond outer frame 42 of loud speaker structure 40, there would be presented space and mounting problems.

Figure 2:
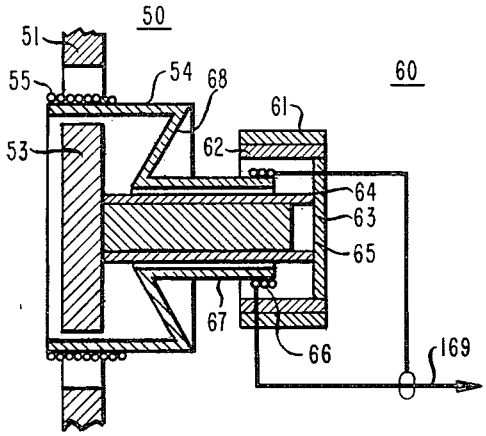
FIG. 2 illustrates a second embodiment of a cone motion sensing structure according to the present invention.
Figure 3:
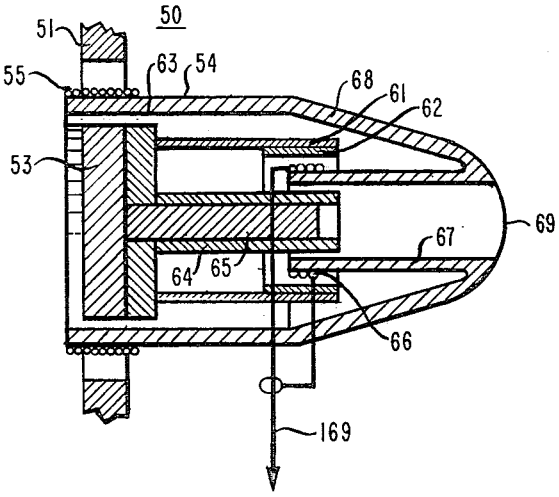
FIG. 3 illustrates a third embodiment of a cone motion sensing structure according to the present invention.

FIGS. 2 and 3 illustrate respective second and third embodiments of cone motion sensing structure 60 according to the present invention. Generally, FIGS. 2 and 3 show optional mounting arrangements of such structure. Conical mechanical support members 68 for connecting feedback bobbin 67 to voice coil bobbin 54 are shown as variations to that shown in FIG. 1. The arrangement of FIG. 2 allows more leeway in positioning sensing structure 60, especially where it is desireable to keep the outer end of the structure within frame 42 of loud speaker structure 40. The arrangement of FIG. 3 shows sensing structure 60 wherein conical mechanical support member 68 covers the whole of sensing structure 60 to minimize the effect of sensing structure 60 on the sound energy output from loud speaker cone 41. In such case, feedback coil 66 and feedback bobbin 67 extend backward into the motional sensing structure field gap. Specifically, in FIG. 3, element 63 is a copper collar and element 69 is a dust cover. It will be apparent to those skilled in the art that configurations as shown in FIGS. 7A, 7B, and 7C of the previous Meyers patent can be had using sound reproducing system 10 herein. Also, it will be apparent that smaller acoustic enclosures can be utilized based on the above.

While the arrangement according to the present invention of a sound reproducing system utilizing motional feedback and an integrated magnetic structure has been described in terms of specific embodiments, it will be apparent to those skilled in the art that many modifications are possible within the spirit and scope of the disclosed principle.

What is claimed is:

1. Means for sensing the motion of the sound producing member driven by the main electromagnetic structure of a loud speaker wherein said main electromagnetic structure exhibits a stray magnetic field, said motion sensing means comprising: first and second iron members being responsive to said stray magnetic field for forming a magnetic field path respectively to and from said main electromagnetic structure, and said first and second iron members forming a gap including said magnetic field path; and feedback means being fixedly attached to said sound producing member and moving uniformly therewith and being located within said gap for sensing the motion of said sound producing member and for producing a motional feedback signal.

2. The motion sensing means of claim 1 wherein:

said main electromagnetic structure further comprises a first pole piece; and said first iron member is fixedly attached to said first pole piece.

3. The motion sensing means of claim 1 further comprising a first non-magnetic electrically conducting metallic member adjacent said first iron member and a second non-magnetic electrically conducting metallic member adjacent said second iron member, said first and second metallic members also being located along said magnetic field path.

4. The motion sensing means of claim 3 wherein said second iron member is located adjacent to said gap.

5. The motion sensing means of claim 3 wherein said second metallic member is located adjacent to said gap.

6. The motion sensing means of claim 3 further comprising a non-magnetic support member for fixedly attaching said second iron member and said second metallic member to said first metallic member.

7. The motion sensing means of claim 3 wherein said first metallic member is made of copper.

8. The motion sensing means of claim 3 wherein said second metallic member is made of copper.

9. The motion sensing means of claim 3 wherein said first metallic member is located adjacent to said gap.

10. The motion sensing means of claim 1 further comprising stability control circuit means being responsive to said feedback means for suppressing the supersonic transmission peaks included within said motional feedback signal.

11. The motion sensing means of claim 10 wherein said stability control circuit means further comprises a resistor and a capacitor in series, said capacitor being connected to ground and said resistor providing said motional feedback signal free from said supersonic transmission peaks.

12. In a loud speaker structure, the combination comprising:

a main electromagnetic structure exhibiting a stray magnetic field and further comprising an inner pole piece and a sound producing member; and means for sensing the motion of said sound producing member comprising:

a first iron member being fixedly attached to said inner pole piece; a second iron member; means for fixedly attaching said first iron member to said second iron member; said first and second iron members being responsive to said stray magnetic field for forming a magnetic field path respectively to and from said main electromagnetic structure, said first and second iron members forming a gap including said magnetic field path; and feedback means being fixedly attached to said sound producing member and moving uniformly therewith and being located within said gap for sensing the motion of said sound producing member and for providing a motional feedback signal.

13. The loud speaker structure of claim 12 wherein said motion sensing means further comprises means being fixedly attached to said sound producing member and being located within said gap for producing an electrical signal which is functionally related to the velocity of said sound producing member.

14. The loud speaker structure of claim 12 wherein said motion sensing means further comprises a first non-magnetic electrically conducting metallic member adjacent said first iron member, being located adjacent to said gap, and being located along said magnetic field path.

15. The loud speaker structure of claim 12 wherein said motion sensing means further comprises a second non-magnetic electrically conducting metallic member being adjacent said second iron member, and being located along said magnetic field path.

16. The loud speaker structure of claim 14 wherein said first metallic member is made of copper.

17. The loud speaker structure of claim 15 wherein said second metallic member is made of copper.

18. The loud speaker structure of claim 12 wherein said second iron member is located adjacent to said gap.

19. The motion sensing means of claim 12 further comprising stability control circuit means being responsive to said feedback means for suppressing the supersonic transmission peaks included within said motional feedback signal.

20. The motion sensing means of claim 19 wherein said stability control circuit means further comprises a resistor and a capacitor in series, said capacitor being connected to ground and said resistor providing said motional feedback signal free from said supersonic transmission peaks.

21. In a loud speaker structure, the combination comprising:

a main electromagnetic structure exhibiting a stray magnetic field and further comprising an inner pole piece and a sound producing member being driven axially by and being responsive to said main electromagnetic structure; and means for sensing the motion of said sound producing member comprising: A solid axially directed cylindrical iron member being fixedly attached to said inner pole piece; a hollow axially directed cylindrical iron member being concentric with said solid iron member; a first hollow axially directed cylindrical copper member being concentric with and adjacent to said solid iron member; a second hollow axially directed cylindrical copper member being concentric with and adjacent to said hollow iron member; means for fixedly attaching said hollow iron member and said second copper member to said first copper member; whereby, an annular axially directed cylindrical gap is formed in between the first copper member and the combination of the hollow iron member and second copper member; and whereby a magnetic field path derived from said stray magnetic field results, said magnetic field path traversing of being located along said inner pole piece, said solid iron member, said first copper member, said gap, the combination comprising the remainder of said second copper member and said hollow iron member, and the remainder of said main electromagnetic structure; and means for sensing the motion of said sound producing member being fixedly attached to said sound producing member and being located within said gap and interacting with said derived magnetic field located within said gap for producing a motional feedback signal which is functionally related to the motion of said sound producing member.

22. The motion sensing means of claim 21 further comprising stability control circuit means being responsive to said feedback means for suppressing the supersonic transmission peaks included within said motional feedback signal.

23. The motion sensing means of claim 22 wherein said stability control circuit means further comprises a resistor and a capacitor in series, said capacitor being connected to ground and said resistor providing said motional feedback signal free from said supersonic transmission peaks.

24. Means for sensing the motion of the sound producing member driven by the main electromagnetic structure of a loud speaker wherein said main electromagnetic structure exhibits a stray magnetic field, said motion sensing means comprising:

first and second metallic members being responsive to said stray magnetic field for collecting, concentrating, and forming a magnetic field path respectively to and from said main electromagnetic structure, said first and second metallic members being fixed relative to said main electromagnetic structure, and said first and second metallic members forming a gap including said magnetic field path; and feedback means being fixedly attached to said sound producing member and moving uniformly therewith and being located within said gap for sensing the motion of said sound producing member and for producing a motional feedback signal.

25. The motion sensing means of claim 24 further comprising a first non-magnetic electrically conducting metallic member adjacent said first metallic member and a second non-magnetic electrically conducting metallic member adjacent said second metallic member, said first and second non-magnetic electrically conducting metallic members also being located along said magnetic field path, and functioning to suppress any variable components derived in said magnetic field path from said stray magnetic field.

26. The motion sensing means of claim 24 further comprising stability control circuit means being responsive to said feedback means for suppressing the supersonic transmission peaks included within said motional feedback signal.

27. The motion sensing means of claim 26 wherein said stability control circuit means further comprises a resistor and a capacitor in series, said capacitor being connected to ground and said resistor providing said motional feedback signal free from said supersonic transmission peaks.

* * * * *